United States Patent [19]

Hirano

[11] Patent Number: 4,658,766

[45] Date of Patent: Apr. 21, 1987

[54] COOLING SYSTEM FOR AUTOMOTIVE ENGINE OR THE LIKE

[75] Inventor: Yoshinori Hirano, Yokohama, Japan

[73] Assignee: Nissan Motor Co., Ltd., Yokohama, Japan

[21] Appl. No.: 779,396

[22] Filed: Sep. 23, 1985

[30] Foreign Application Priority Data

Sep. 29, 1984 [JP] Japan ..... 59-202935

[51] Int. Cl.[4] ..... F01P 3/22

[52] U.S. Cl. ..... 123/41.27; 123/41.44

[58] Field of Search ..... 123/41.2–41.27, 123/41.44, 41.02

[56] References Cited

U.S. PATENT DOCUMENTS

| | | | |
|---|---|---|---|
| 4,367,699 | 1/1983 | Evans | 123/41.49 |
| 4,565,162 | 1/1986 | Seki et al. | 123/41.21 |
| 4,574,747 | 3/1986 | Hirano | 123/41.27 |

*Primary Examiner*—William A. Cuchlinski, Jr.

*Attorney, Agent, or Firm*—Schwartz, Jeffery, Schwaab, Mack, Blumenthal & Evans

[57] ABSTRACT

In order to simultaneously control cooling system overheat and purge out any non-condensible matter that has come out of solution during engine warm-up and which has not be purged during a cold engine start, a valve and conduit arrangement which controls the communication between a reservoir located externally of the cooling circuit in which liquid coolant is permitted boil and the vapor used as a vehicle for removing heat from the heated structure of the engine, is conditioned so that firstly a valve located at a relatively low level is opened to render the cooling circuit open circuit and permit pressurized coolant vapor to move down through the radiator of the system in a manner which tends to carry any non-condensible matter with it out to the reservoir. Should this measure prove ineffective in obviating the overheat condition within a preselected period of time, then a second valve located at high level on the system is opened to additionally vent coolant vapor to the reservoir.

5 Claims, 19 Drawing Figures

COOLING SYSTEM FOR AUTOMOTIVE ENGINE OR THE LIKE

BACKGROUND OF THE INVENTION

1. Field of the Invention

The present invention relates generally to a cooling system for an internal combustion engine wherein a liquid coolant is permitted to boil and the vapor used as a vehicle for removing heat from the engine, and more specifically to such a system which enables non-condensible matter to be purged from the system both at the initial start-up of the engine and when the engine is fully warmed up and running so as to completely rid the system of the air and the like which is dissolved and low temperatures and comes out of solution upon sufficient heating of the coolant occuring.

2. Description of the Prior Art

In currently used 'water cooled' internal combustion engine such as shown in FIG. 1 of the drawings, the engine coolant (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the necessary amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kgm of water may effectively remove from the engine under such conditions is 4 Kcal. Accordingly, in the case of an engine having 1800cc displacement (by way of example) is operated full throttle, the cooling system is required to remove approximately 4000 Kcal/h. In order to achieve this, a flow rate of 167 liter/min (viz., $4000-60\times\frac{1}{4}$) must be produced by the water pump. This of course undesirably consumes a number of useful horsepower.

FIG. 2 shows an arrangement disclosed in Japanese patent application Second Provisional Publication Sho. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to gradually escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to form small bubbles in the radiator which adhere to the walls thereof forming an insulating layer. The undissolved air also tends to collect in the upper section of the radiator and inhibit the convention-like circulation of the vapor from the cylinder block to the radiator. This of course further deteriorates the performance of the device.

European patent application Provisional Publication No. 0 059 423 published on Sept. 8, 1982 discloses another arrangement wherein, liquid coolant in the coolant jacket of the engine, is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. Accordingly, air, due to this inherent tendency to rise, forms pockets of air which cause a kind of 'embolism' in the radiator and badly impair the heat exchange ability thereof.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the 'dry' gaseous coolant (steam for example) is condensed in a fan cooled radiator 8. The temperature of the radiator is controlled by selective energizations of the fan 9 to maintain a rate of condensation therein sufficient to maintain a liquid seal at the bottom of the device. Condensate discharged from the radiator via the above mentioned liquid seal is collected in a small reservoir-like arrangement 10 and pumped back up to the separation tank via a small constantly energized pump 11.

This arrangement, while providing an arrangement via which air can be initially purged to some degree from the system tends to, due to the nature of the arrangement which permits said initial non-condensible matter to be forced out of the system, suffer from rapid loss of coolant when operated at relatively high altitudes. Further, once the engine cools air is relatively freely admitted back into the system.

The provision of the separation tank 6 also renders engine layout difficult in that such a tank must be placed at relatively high position with respect to the engine, and contain a relatively large amount of coolant so as to buffer the fluctuations in coolant consumption in the coolant jacket. That is to say, as the pump 11 which lifts the coolant from the small reservoir arrangement located below the radiator, is constantly energized (apparently to obivate the need for level sensors and the like arrangement which could control the amount of coolant returned to the coolant jacket) the amount of coolant stored in the seperation tank must be sufficient as to allow for sudden variations in the amount of coolant consumed in the coolant jacket due to sudden changes in the amount of fuel combusted in the combustion chambers of the engine.

Japanese patent application First Provisional Publication No. sho. 56-32026 (see FIG. 4 of the drawings) discloses an arrangement wherein the structure defining the cylinder head and cylinder liners are covered in a porous layer of ceramic material 12 and coolant sprayed into the cylinder block from shower-like arrangements 13 located above the cylinder heads 14. The interior of the coolant jacket defined within the engine proper is essentially filled with only gaseous coolant during engine operation during which liquid coolant is sprayed onto the ceramic layers 12. However, this arrangement has proven totally unsatisfactory in that upon boiling of the liquid coolant absorbed into the eramic layers, the vapor thus produced and which escapes into the coolant jacket inhibits the penetration of fresh liquid coolant and induces the situation wherein rapid overheat and thermal damage of the ceramic layers 12 and/or engine soon results. Further, this arrangement is plagued with air contamination and blockages in the radiator similar to the compressor equipped arrangement discussed above.

FIG. 7 shows an arrangement which is disclosed in U.S. Pat. No. 4,549,505 issued on Oct. 29, 1985 in the name of Hirano. The disclosure of this application is hereby incorporated by reference thereto.

This arrangement while overcoming a lot of the problems involved with the above prior art has itself suffered from the problem that even though a non-condensible matter purge is performed when the engine is cold, still some air tends to remain dissolved in the coolant and cannot be removed at low temperatures. Accordingly, when the engine warms up to a level whereat the 'cold purge' cannot be performed, this air tends to come out of solution and find its way into the conduiting of the radiator wherein, due to its inherent tendency to rise in the hot environment, it tends to block to the downward convection of the vapor as it cools and begins to condense to its liquid form. Accordingly, this particular arrangement has suffered from the tendancy to overheat under prolonged high load operation.

SUMMARY OF THE INVENTION

It is an object of the present invention to provide an evaporative type cooling system for an automotive internal combustion engine or the like which can perform both hot and cold non-condensible matter purges so that in the event of an overheat of the engine during normal running one or more momentary hot purge operations can be performed to rid the system of any air or the like non-condensible matter that may have appeared after the engine has warmed-up, and which can also open a second valve if the pressure relief expected by the hot purges is not forthcomming.

In brief, the above object is achieved by an arrangment wherein in order to simultaneously control cooling system overheat and purge out any non-condensible matter that has come out of solution during engine warm-up and which has not be purged during a cold engine start, a valve and conduit arrangement which controls the communication between a reservoir located externally of the cooling circuit in which liquid coolant is permitted boil and the vapor used as a vehicle for removing heat from the heated structure of the engine, is conditioned so that firstly a valve located at a relatively low level is opened to render the cooling circuit open circuit and permit pressurized coolant vapor to move down through the radiator of the system in a manner which tends to carry any non-condensible matter with it out to the reservoir. Should this measure prove ineffective in obviating the overheat condition within a preselected period of time, then a second valve located at high level on the system is opened to additionally vent coolant vapor.

More specifically, the present invention takes the form of an internal combustion engine having a structure subject to high heat flux and which is characterized by a cooling circuit for removing heat from the engine comprising: a coolant jacket formed about the structure, the coolant jacket being arranged to receive coolant in liquid form and discharge same in gaseous form; a radiator in which the gaseous coolant produced in the coolant jacket is condensed to its liquid form; a vapor transfer conduit leading from the coolant jacket to the radiator for transfering gaseous coolant from the coolant jacket to the radiator; a device associated with the radiator for varying the rate of heat exchange between the radiator and a cooling medium surrounding the radiator; a liquid coolant return conduit leading from the radiator to the coolant jacket for returning coolant condensed to its liquid state in the radiator to the coolant jacket; a reservoir the interior of which is maintained constantly at atmospheric pressure; valve and conduit means for selectively interconnecting the reservoir and the cooling circuit, the valve and conduit means including; a supply conduit which leads from the reservoir to the bottom of the radiator; a first valve disposed in the supply conduit, the first valve having a first position wherein communication between the reservoir and the radiator is permitted and a second position wherein the fluid communication between the reservoir and the radiator is prevented; a second three-way valve disposed in the return conduit and a level control conduit leading from the three-way valve to the reservoir, the three-way valve having a first state wherein fluid communication between the radiator and the coolant jacket is interrupted and communication between the radiator and the reservoir established, and a second state wherein communication between the reservoir and the radiator is interrupted and communication between the radiator and the coolant jacket established; an overflow conduit which fluidly communicates with the cooling circuit at a first end thereof and with the reservoir at a second end thereof; a third valve disposed in the overflow conduit, the third valve having a first position wherein fluid communication between the cooling circuit via the overflow conduit is prevented and a second position wherein fluid communication between the cooling circuit and the radiator via the overflow conduit is permitted; a reversible pump disposed in the coolant return conduit at a location between the radiator and the three-way valve, the pump being selectively energizable to pump coolant in (a) a first flow direction from the radiator toward the three-way valve and (b) in a second flow direction from the three-way valve toward the radiator; a first sensor for sensing a parameter which varies with the temperature of the liquid coolant in the coolant jacket; a second sensor for sensing a parameter which varies with the load on the engine; and a control circuit responsive to the first and second sensors for controlling the operation of the device, the valve and conduit means and the pump, the control circuit including means for; determining the operational mode of the engine; deriving a target temperature at which the liquid coolant in the coolant jacket should be maintained; operating the device in a manner to vary the rate of condensation in the radiator and bring the temperature of the coolant in the coolant jacket to the target temperature, operating the first valve in a manner which vents excess pressure from the cooling circuit in the event that the first sensor indicates that the temperature in the coolant jacket is in excess of a maximum permissible limit; and operating the third valve in a manner to permit communication between the cooling circuit and the reservoir via the overflow conduit in the event that the temperature and pressure in the cooling circuit do not decrease below the maximum permissible limit within a predetermined time period after the first valve is opened for the venting purpose.

BRIEF DESCRIPTION OF THE DRAWINGS

The features and advantages of the arrangement of the present invention will become more clearly appreciated from the following description taken in conjunction with the following drawings in which.

DETAILED DESCRIPTION OF THE PREFERRED EMBODIMENT

Before proceeding with the description of the embodiments of the present invention, it is deemed appropriate to discuss same of the concepts on which the present invention is based.

Figure 1:
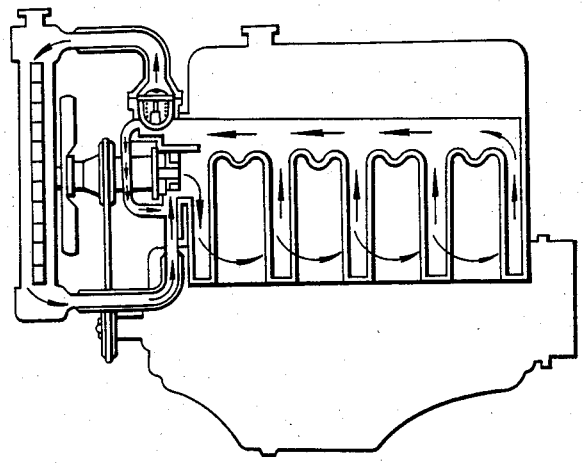
FIG.1 (PRIOR ART)
FIG. 1 is a sectional elevation showing the currently used conventional water circulation type system discussed in the opening paragraphs of the instant disclosure.
Figure 2:
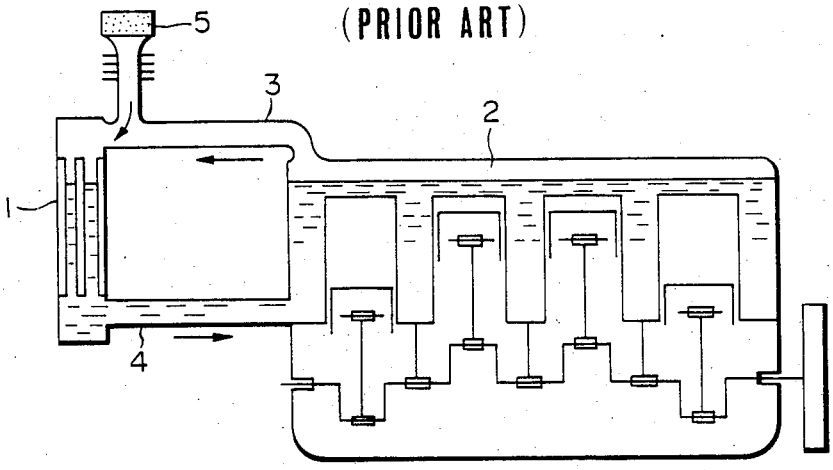
FIG.2 (PRIOR ART)
FIG. 2 is a schematic side sectional elevation of a prior art arrangement also discussed briefly in the earlier part of the specification.
Figure 3:
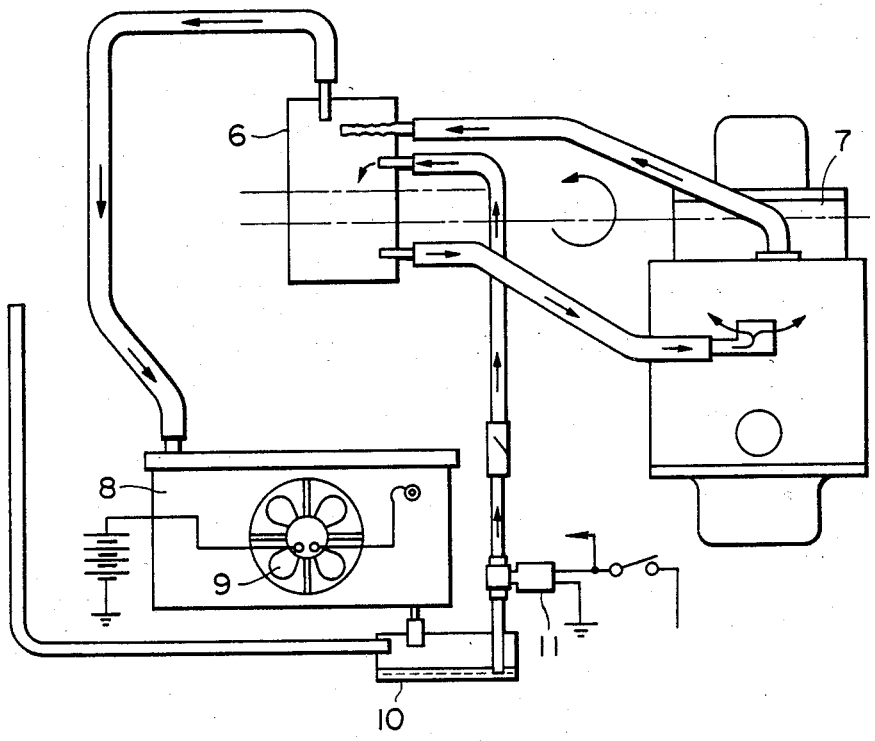
FIG.3 (PRIOR ART)
FIG. 3 shows in schematic layout form, another of the prior art arrangements previously discussed.
Figure 4:
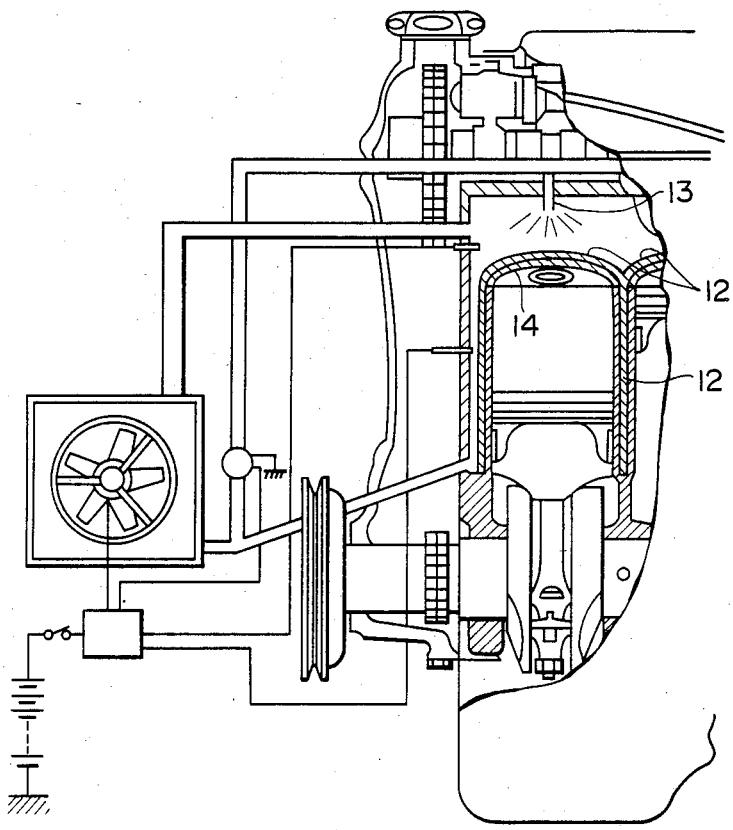
FIG.4 (PRIOR ART)
FIG. 4 shows in partial section yet another of the previously discussed prior art arrangements.
Figure 5:
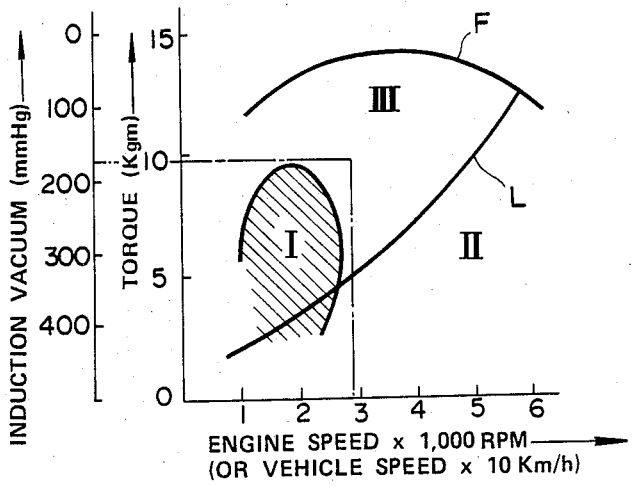
FIG. 5 is a graph showing in terms of induction vacuum (load) and engine speed the various load zones encountered by an automotive internal combustion engine.

FIG. 5 graphically shows in terms of engine torque and engine speed the various load 'zones' which are encountered by an automotive vehicle engine. In this graph, the curve F denotes full throttle torque characteristics, trace L denotes the resistance encountered when a vehicle is running on a level surface, and zones I, II and III denote respectively 'urban cruising', 'high speed cruising' and 'high load operation' (such as hill-climbing, towing etc.).

A suitable coolant temperature for zone I is approximately 110° C. while 90°-80° C. for zones II and III. The high temperature during 'urban cruising' promotes improved thermal efficiency while simultaneously removing sufficient heat from the engine and associated structure to prevent engine knocking and/or engine damage in the other zones. For operational modes which fall between the aforementioned first, second and third zones, it is possible to maintain the engine coolant temperature at approximately 100° C.

Figure 7:
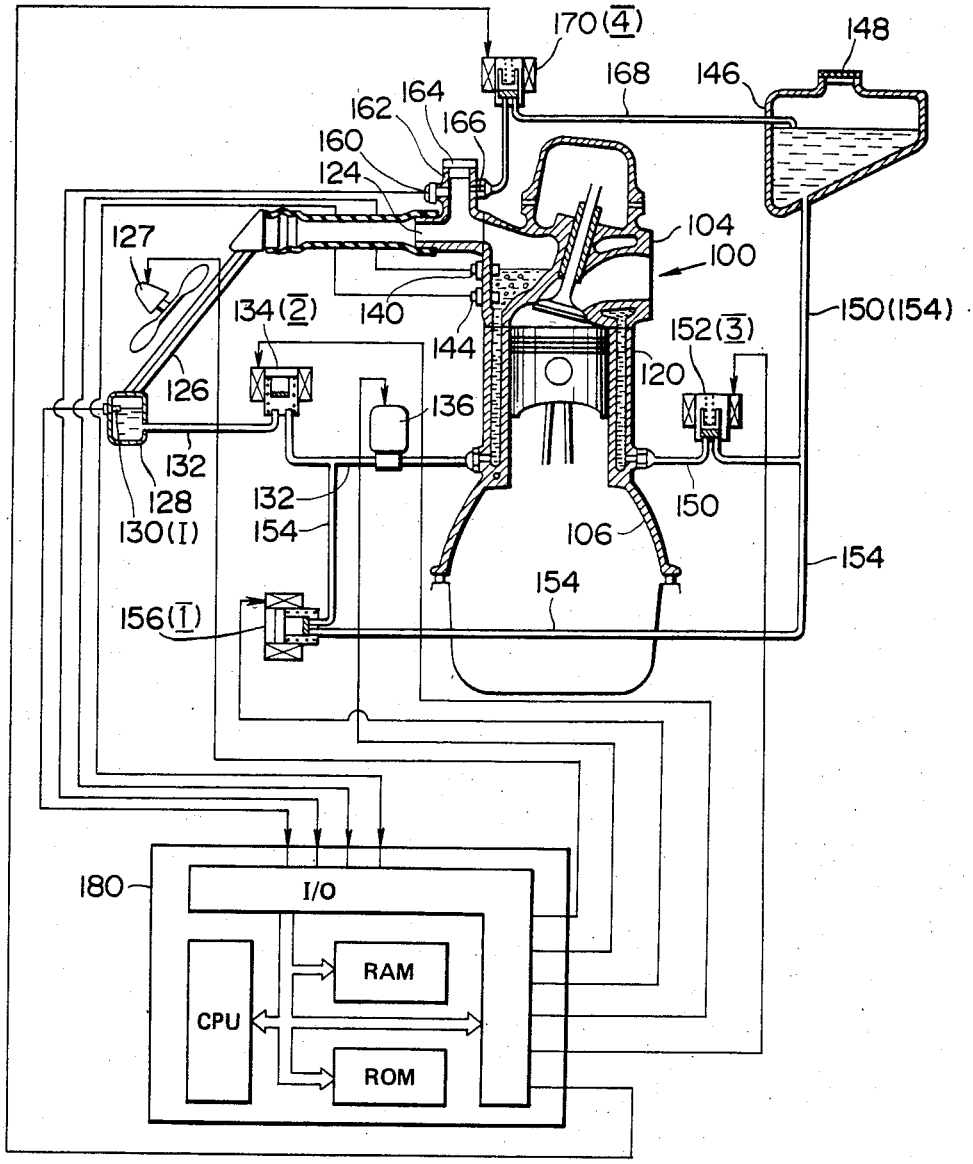
FIG. 7 shows in schematic elevation the arrangement disclosed in the opening paragraphs of the instant disclosure in conjunction with copending U.S. Ser. No. 661,911.

With the present invention, in order to control the temperature of the engine, advantage is taken of the fact that with a cooling system wherein the coolant is boiled and the vapor used a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is closed. Thus, by circulating only a limited amount of cooling air over the radiator, it is possible reduce the rate of condensation therein and cause the pressure within the cooling system to rise above atmospheric and thus induce the situation, as shown in FIG. 7, wherein the engine coolant boils at temperatures above 100° C. for example at approximately 119° C. (corresponding to a pressure of approximately 1.9 Atmospheres).

On the other hand, during high speed cruising, it is further possible by increasing the flow cooling air passing over the radiator, to increase the rate of condensation within the radiator to a level which reduces the pressure prevailing in the cooling system below atmospheric and thus induce the situation wherein the coolant boils at temperatures in the order of 80° to 90° C. However, under such conditions the tendency for air to find its way into the interior of the cooling circuit becomes excessively high and it is desirable under these circumstances to limit the degree to which a negative pressure is permitted to develop. This can be achieved by permitting coolant to be introduced into the cooling circuit from the reservoir and thus raise the pressure in the system to a suitable level.

Figure 8:
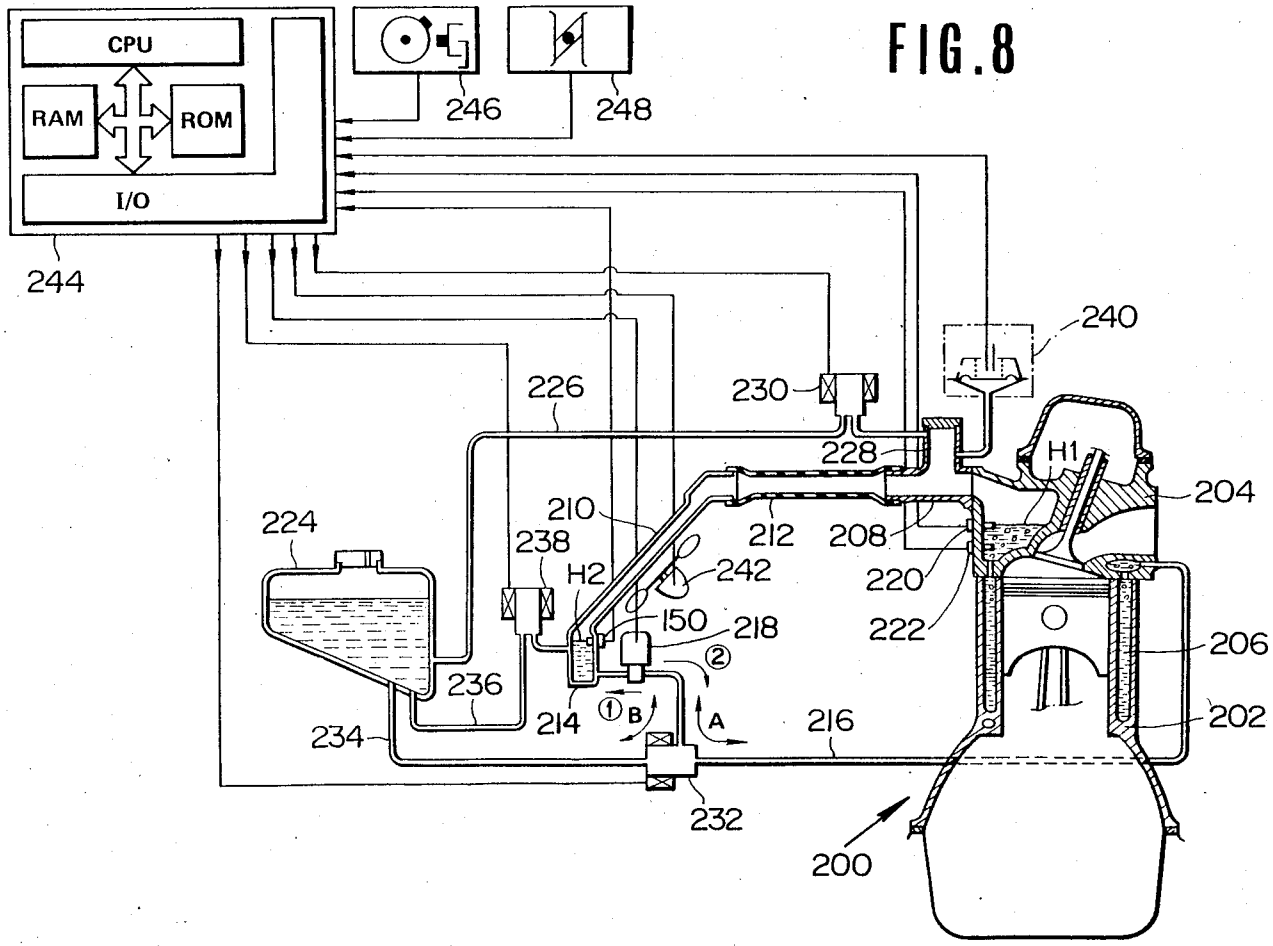
FIG. 8 shows an embodiment of the present invention.

FIG. 8 shows an embodiment of the present invention. In this arrangement an engine 200 includes a cylinder block 202 on which a cylinder head 204 is detachably mounted. The cylinder block and cylinder head are formed with cavities which define a coolant jacket 206 about the heated structure of the engine.

A vapor manifold 208 is detachably mounted on the cylinder head 202 and arranged to communicate with a condensor or radiator (as it will be referred to hereinafter) 210 via a vapor transfer conduit 212.

In this embodiment the radiator 210 comprises a plurality of relatively small diameter conduits which terminate in a small collection vessel or lower tank 214. A coolant return conduit 216 leads from the lower tank 214 to the coolant jacket 206. In this embodiment the return conduit 216 communicates with the cylinder head 204 at a location proximate the most highly heated structure of the engine 200. This arrangement introduces the relatively cool coolant into a section of the coolant jacket 206 where the most vigorous boiling tends to occur and therefore tends to attenuate the bumping and frothing which normally accompanies same. However, it is also within the scope of the present invention to connect the return conduit 216 to a port formed in the section of the coolant jacket 206 defined within the cylinder block 202 if so desired.

A small capacity coolant return pump 218 is disposed in conduit 216 as shown. This pump is arranged to be selectively energizable to pump coolant from said lower tank 214 toward the coolant jacket 206 (viz., a first flow direction) and in the reverse direction (second flow direction). The reason for this arrangement will become clear hereinlater.

In order to control the operation of pump 218 (in the first flow direction) a first level sensor 220 is disposed in the coolant jacket. As shown this level sensor 220 is arranged at a level H1 which is selected to be a predetermined height above the structure which defines the cylinder heads, exhaust ports and valves of the engine (viz., structure subject to a high heat flux) so as to maintain same immersed in sufficient coolant and thus obviate the formation of localized dryouts (induced by excessively violent bumping and frothing of the coolant) and thus avoid engine damage due to localized overheating and the like. This sensor may be arranged to exhibit hysteresis characteristics so as to prevent raid ON/OFF cycling of pump 218.

Disposed below the level sensor 220 so as to be securely immersed in liquid coolant and in relatively close proximity to the most highly heated structure of the engine is a temperature sensor 222.

A reservoir 224, the interior of which is maintained constantly at atmospheric presure, is arranged to fluidly communicate with what shall be referred to as a 'cooling circuit' (viz., a circuit comprised of the coolant jacket 206, the vapor manifold 208, the vapor transfer conduit 212 and coolant return conduit 216) via a 'valve and conduit' arrangement. In this embodiment the valve and conduit arrangement comprises an overflow conduit 226 which leads from a riser 228 formed in the vapor manifold 208; a first valve 230 which normally closes the overflow conduit 226 and which permits communication between the riser 228 and the reservoir 224 upon energization; a second three-way valve 232 disposed in the coolant return conduit 216 and which is arranged to have a first position wherein communication between the pump 218 and the coolant jacket 206 is established (viz., establish flow path A) and a second position wherein communication between the pump 216 and the reservoir 224 is established (flow path B) via an induction conduit 234; a fill/displacement conduit 236 which leads from the reservoir 224 to the lower tank 214; and a third valve 238 which permits communication between the lower tank 214 and the reservoir 224 when de-energized and which cuts-off said communication upon energization.

In order to sense the pressure prevailing in the cooling circuit a pressure differential responsive switch arrangement 240 is arranged to communicate with the riser 228 as shown. This switch is arranged to be triggered to output a signal upon the pressure in the vapor manifold 208 dropping a predetermined amount below ambient atmospheric pressure.

A small electric fan 242 or like device is disposed beside the radiator 210 and arranged to force a draft of air over the surface of the radiator 210 and thus induce an increase in the heat exchange between the radiator and the surrounding atmospheric air.

A control circuit 244 which in this embodiment includes a microprocessor comprising a CPU, a RAM a ROM and an in/out interface I/O is arranged to receive inputs from temperature sensor 222 and level sensor 220. This circuit also receives data inputs from an engine speed sensor 246, a engine load sensor 248 and a second level sensor 250 disposed in lower tank 214 at a level essentially equal to that at which the fill/discharge conduit 236 communicates with same.

The ROM of the microprocessor contains various control programs which are used to control the operation of the fan 242, pump 218 and valves 230, 232 and 238 of the valve and conduit arrangement. These programs will be discussed in detail hereinlater.

Figure 18:
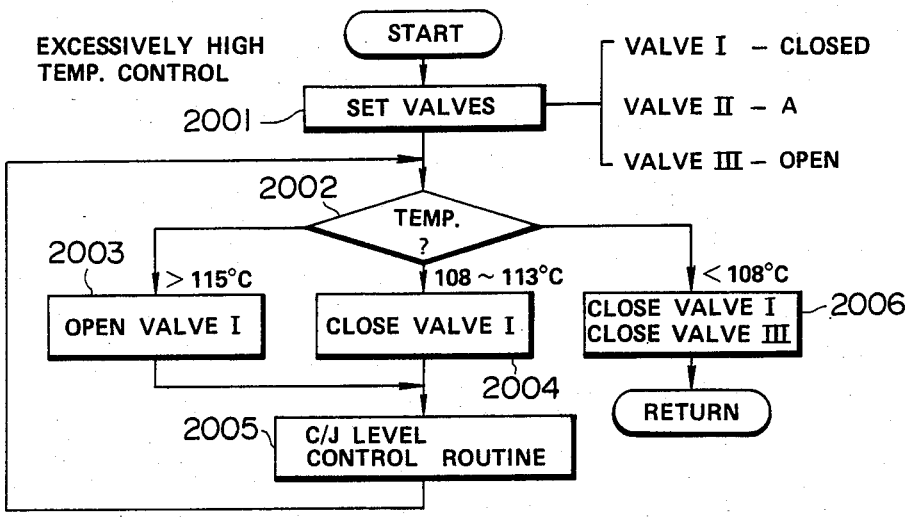

Prior being put into use it is necessary to completely fill the cooling circuit with coolant and displace any non-condensible matter. To do this it is possible to remove the cap (no numeral) which closes the riser 228 and manually fill the system with liquid coolant (for example water or a mixture of water and anti-freeze). Alternatively, or in combination with the above, it is possible to introduce excess coolant into reservoir 224, condition valve 232 to produce flow path B and energize pump 218 until such time as coolant may be visibly seen spilling out of the open riser. By securing cap in place at this time it is possible to hermetically seal the system is a completely filled condition. However, even under these conditions the coolant still tends to contain dissolved air which will come out of solution upon sufficient heating. Measures for dealing with this non-condensible matter if it is necessary is set forth hereinlater in connection with the flow chart of FIG. 18.

Figure 9:
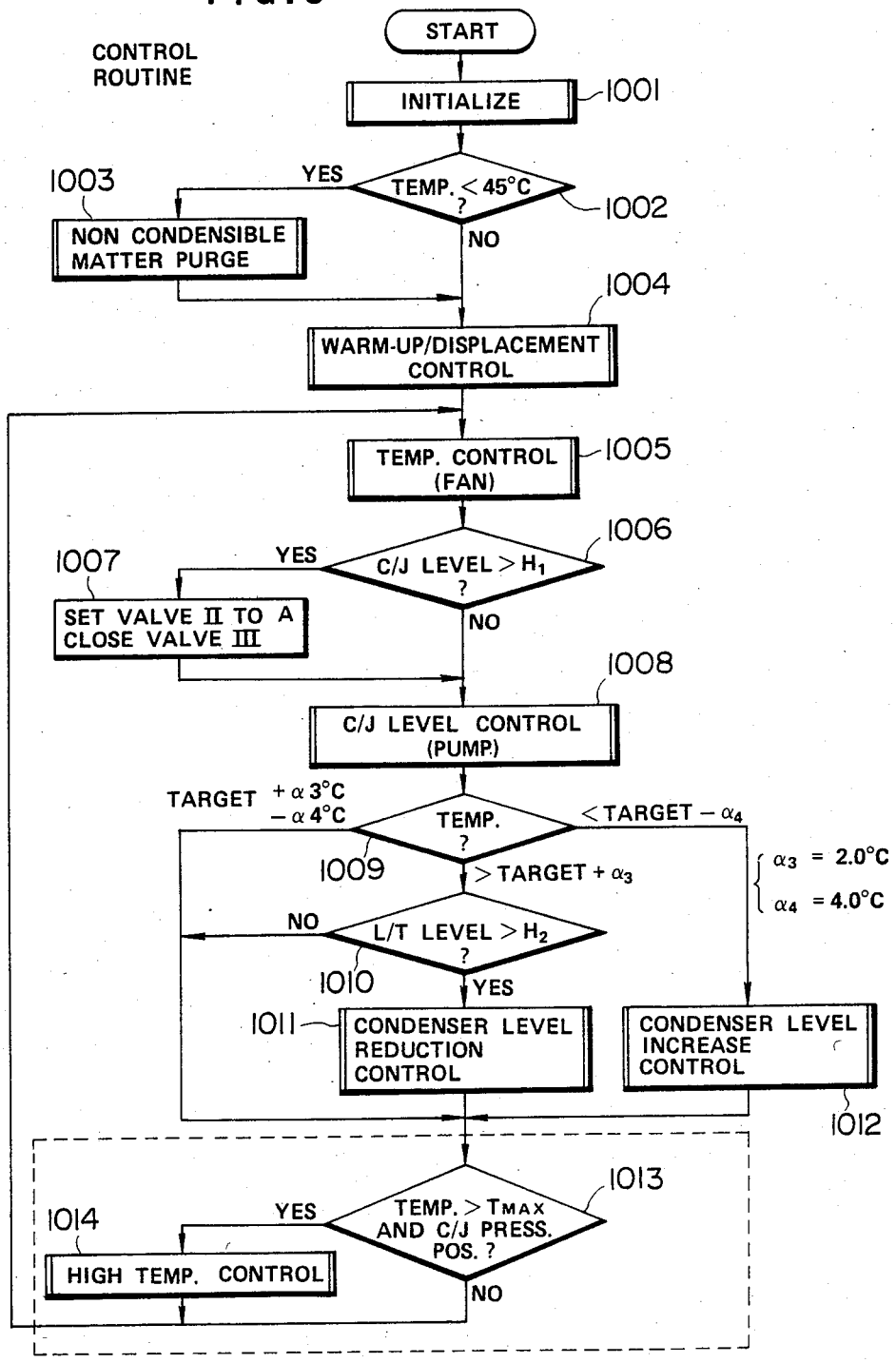
FIGS. 9 to 19 show flow charts which depict the operations which characterize the operation of the arrangement shown in FIG. 8.

FIG. 9 shows in flow chart form a control routine which manages the overall operation of the arrangement shown in FIG. 8. As shown, subsequent to start of the engine, the control system is initialized in step 1001. At step 1002 the coolant temperature is determined by sampling the output of temperature sensor 222. In the event that the coolant temperature is below a predetermined level which in this case is selected to be 45° C., the control program flows to step 1003 wherein a non-condensible matter purge sub-routine is run. However, if the temperature is above 45° C. then the program by-passes the purge operation and proceeds directly to step 1004 on the assumption that as the coolant is still warm, the engine has not cooled sufficiently and there has been insufficient time for atmospheric air or the like to have leaked into and contaminated the cooling circuit of the engine.

At step 1004 a warm-up/displacement mode of operation is entered. During this routine any excess coolant which has entered the cooling circuit while the engine was stopped will be displaced until (a) the coolant boils at a temperature which is deemed appropriate for the instant mode of engine operation or (b) a minimum amount of coolant (viz., the coolant in the coolant jacket 206 and lower tank 214 both assume level H1 and H2 respectively).

It should be noted that when the engine is stopped and has assumed a predetermined condition under the control of a 'shut-down' control routine, that liquid coolant from the reservoir 224 is permitted to be introduced into the coolant circuit under the influence of the pressure differential which develops as the coolant vapor condenses to its liquid state. Accordingly, depending on the temperature of the coolant and the amount of coolant vapor which is present in the cooling circuit, the latter will tend to be partially to completely filled with liquid coolant.

Following the coolant displacement the control program flows to step 1005 wherein the operation of the fan 242 is controlled in a manner to maintain the temperature of the coolant in the coolant jacket 206 at a level which is deemed to be most appropriate for the instant set of engine operational conditions.

At step 1006 the level of coolant in the coolant jacket is determined by sampling the output of level sensor 220. In the event that the level of liquid coolant is above H1 then at step 1007 valves 232 and 238 are conditioned to establish flow path A and assume a closed condition, respectively.

In order to facilitate easy explanation, a convention wherein valves 230, 232 and 238 will be referred to as valves I, II and III—viz., in order from right to left as viewed in FIG. 8.

Under the above described set of conditions the system is caused to assume a hermetically closed state and for pump 232 to be conditioned to induct coolant from the lower tank 224 and direct same toward and into the coolant jacket 206. Subsequently, a coolant jacket coolant level control routine is entered at step 1008.

At step 1009 the temperature of the coolant is sampled and ranged in a manner that if the temperature of the coolant less than Target$+\alpha 3$ and greater than Target$-\alpha 4$ (where Target is the temperature deemed to be that most suited for the instant set of engine operating conditions, and wherein $\alpha 3=2.0°$ C. and $\alpha 4=4.0°$ C.) then the program flows directly to step 1013 while if greater than Target$+\alpha 3$ then at step 1010 the output of level sensor 250 is sampled to determine whether the level of liquid coolant in lower tank 214 is above or below level H2. If the level is determined to be below sensor 250 then the program flows directly to step 1013. On the other hand if excess coolant is detected in the lower tank 214 then at step 1011 a routine which reduces the amount of liquid in that section of the cooling circuit is implemented. On the contrary, if the temperature determined at step 1009 is less than a value of Target$-\alpha 4$ then the program goes to step 1012 wherein the amount of coolant in the lower tank 214 and radiator 210 is increased to simultaneously increase the pressure in the system and reduce the surface area available for coolant vapor produced in the coolant jacket to release its latent heat of evaporation and condense to its liquid form.

At step 1013 it is determined if both the coolant temperature is above a maximum allowable limit and the pressure in the cooling circuit is above atmospheric. If the outcome of this inquiry is NO then the program recycles to step 1003. However, if the answer is YES and the cooling system is deemed to have entered a state of 'overheat', and at step 1014 a routine designed to control this state by suitably rendering the cooling circuit 'open circuit' by degrees which varies with the temperature level, is entered.

Figure 10:
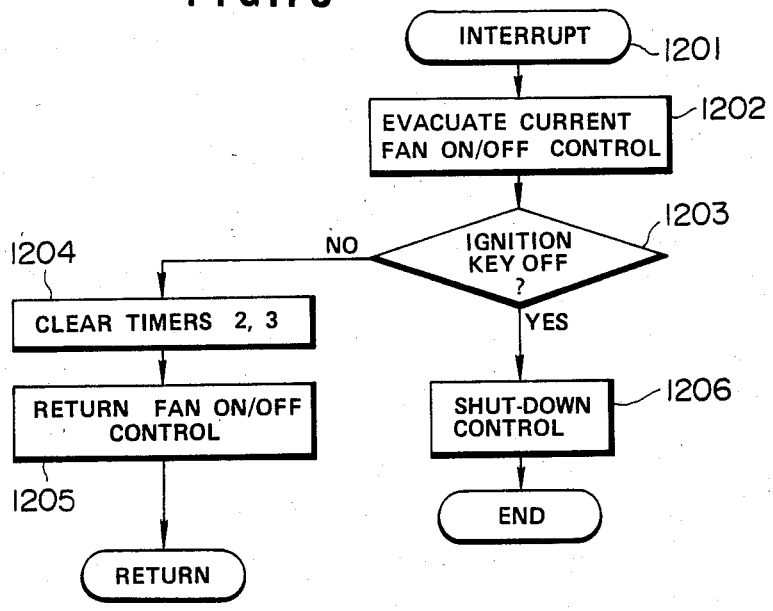

FIG. 10 shows the interrupt routine which is run each time the engine stops. As shown, subsequent to the interrupt (step 1201) which breaks into the currently run control routine upon engine stoppage, the current fan control data is evacuated from the CPU at step 1202. It will be noted that the output of the engine speed sensor can be used to detect the zero RPM engine status.

Figure 19:
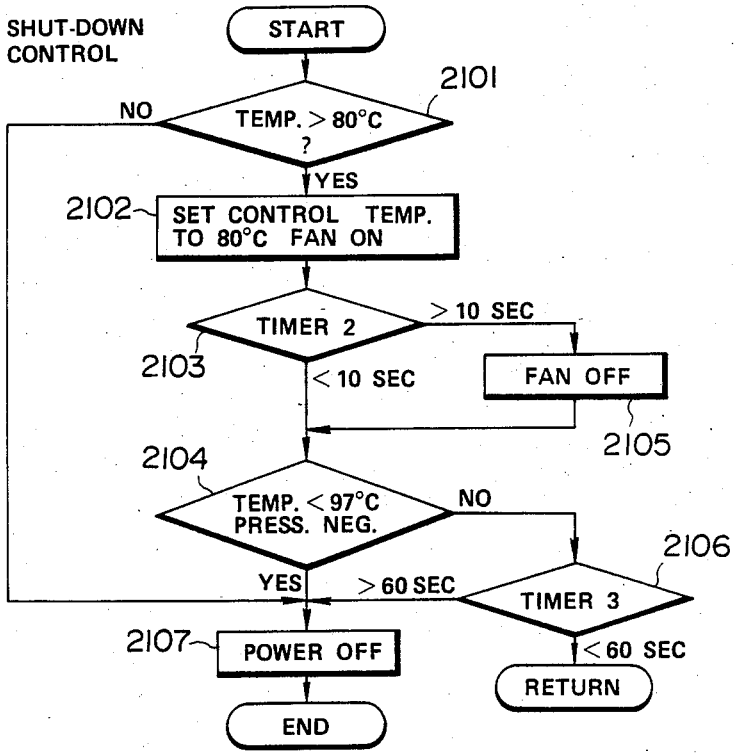

At step 1203 the status of the ignition key is determined in order to ascertain if the engine has merely stalled and will be immediately re-started or has been deliberately stopped. In the event that the ignition key is still ON then at step 1204 soft clocks or timers 2 and 3 are cleared and at step 1205 the previously evacuated control data re-instated. Following this a suitable control program is re-entered. However, in the event that the ignition key is found to be off in step 1203 then at step 1206 'shut-down' control routine is entered. This routine will be set forth in detail hereinlater in connection with FIG. 19.

Non-Condensible Matter Purge Control

Figure 11:
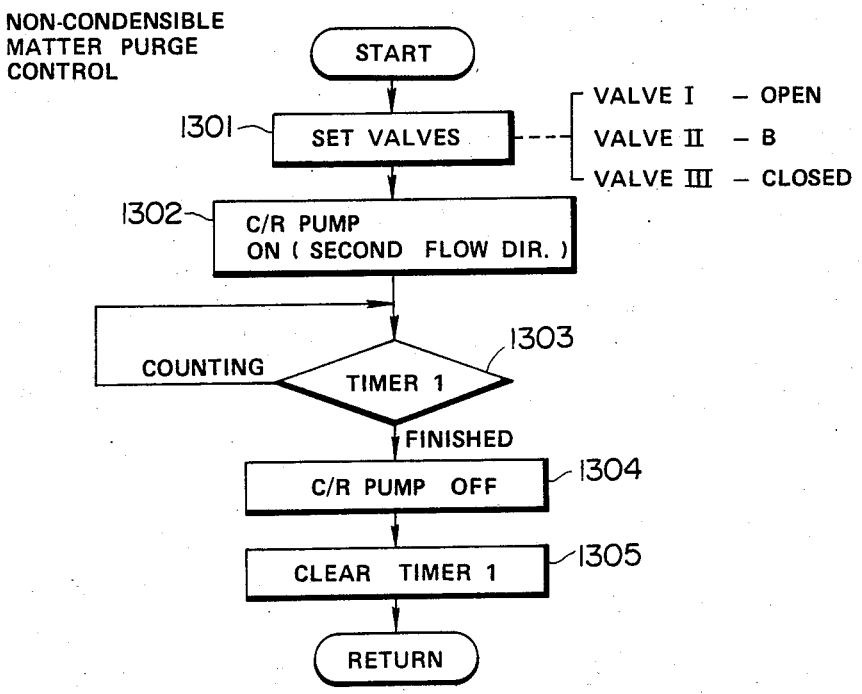
Figure 12:
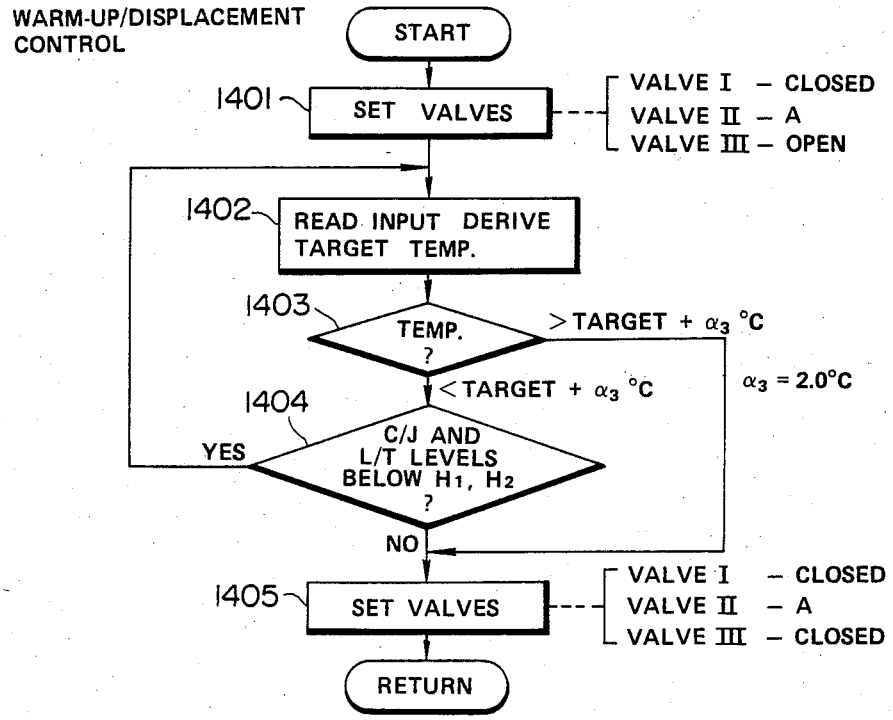

FIG. 11 shows the routine which is effected in order to flush out any traces of air and the like when the temperature of the coolant is below a predetermined level (viz., 45° C.—see step 1002 in FIG. 9).

The first step (1301) of this routine is such as to condition valve I to III as shown. Viz., the valve and conduit arrangement is conditioned in a manner which permits coolant to be inducted from the reservoir 224 by pump 218 and forced into the lower tank 214 while communication between the riser 228 and the reservoir 224 is established via overflow conduit 226. At step 1302 pump 218 is energized in the second flow direction. This condition is maintained by a soft clock or 'timer 1' for a predetermined period of time. Depending on the engine and or various other factors the period for which timer 1 maintains the pump on for, can vary from several tens of seconds to one or even two minutes. For example, in cold climates it is desirable to limit the time for which the purge is carried out to the minimum so as to avoid pumping very cold coolant into the coolant jacket 206 at a time when it is desired to raise the temperature 200 of the engine to its normal operational level as quickly as possible. Further, if several seconds of pump 218 operation is sufficient to completely fill the system and remove the undissolved air and the like from the system, further operation is merely wasteful.

At steps 1304 and 1305 the operation of pump 218 is terminated and the soft clock 'timer 1' cleared ready for subsequently purge operations.

Warm-up/Displacement Control

Figure 6:
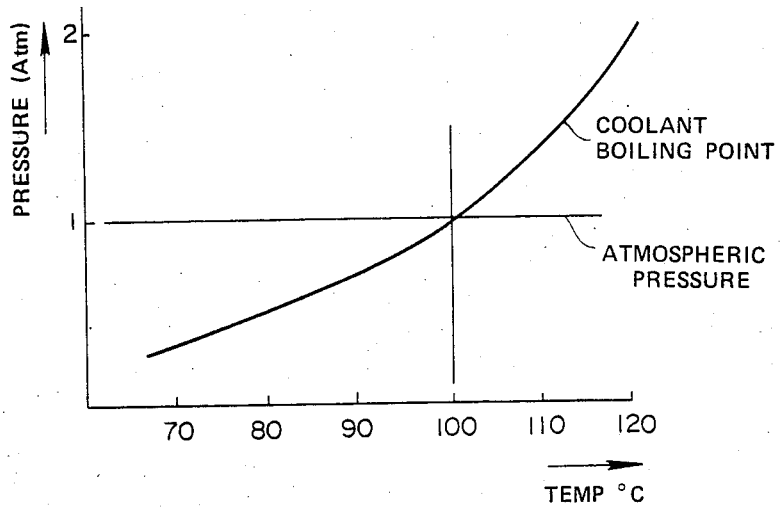
FIG. 6 is a graph showing in terms of pressure and temperature, the change which occurs in the coolant boiling point with change in pressure.

Upon entering this mode of operation, valves I to III are conditioned at step 1401 as shown. Viz., the system is placed in a open circuit condition by opening valve 238 and arranging for flow path A to be established so that pump 218 can pump coolant from the lower tank 214 to the coolant jacket 206. At step 1402 the various inputs from the engine speed sensor 246 and the engine load sensor 248 are read and a decision made in view of same as to what temperature the coolant should be controlled to. This particular decision can be made via table look-up wherein data of the nature shown in FIG. 6 is logged in the ROM of the microprocessor or alternatively can be mathematically derived using a suitable program. As the various manners in which this particular decision can be made will be clear to those skilled in the art of programming when equipped the data given in from FIG. 6 and the disclosure of the instant specification, no further description will be given for the sake of brevity.

At step 1404 the output of the temperature sensor 222 is sampled. In the event that the coolant temperature is greater than target$+\alpha 3$ the program flows to step 1405 wherein valves I to III are conditioned in a manner which seals the system into a hermetically closed state and establishes flow path A. On the other hand, in the event that the outcome of the inquiry conducted at step 1403 indicates that the temperature of the coolant is less than target$+\alpha 3$ then the program proceeds to step 1404 wherein it is determined if the level of liquid coolant in the coolant jacket 206 and that in the lower tank 214 are both above levels H1 and H2 respectively. It the outcome of this inquiry reveals that the levels are in fact both above the predetermined levels the program recycles to step 1402 to permit the system to remain in a state wherein further coolant can displaced from the cooling circuit under the influence of the vapor pressure which is developing in the vapor collection spaced defined within the coolant jacket 206 above level H1. However, in the event that either one of the levels is lower than the respective sensor, the program flows to step 1405 to seal the system and prevent the possibility of coolant over-discharge taking place.

Temperature Control Routine

Figure 13:
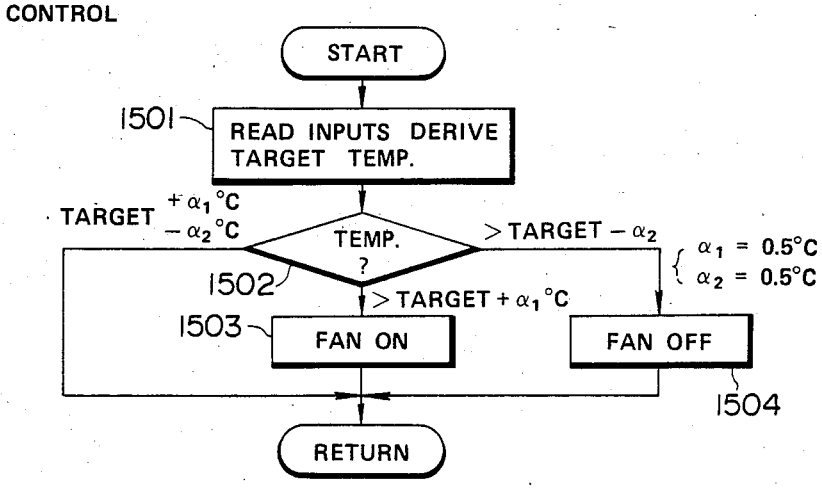

FIG. 13 shows the steps executed to control the fan 242 in a manner to control the temperature of the coolant at or within close proximity of the desired target level. In this routine the inputs from the engine speed and load sensors 246 and 248 are read at step 1501 and the appropriate target temperature derived in a manner as previously described. At step 1502 the coolant temperature is sampled. In the event that the temperature is within the range of target$+\alpha 1$ to target$-\alpha 2$ then the program returns while in the event that the coolant temperature is on the high side (greater than target$+\alpha 1$) the at step 1503 a command to energize fan 242 is issued. On the other hand, in the event that the temperature is on the low side (less than target$-\alpha 2$) then a command to stop the operation of the fan 242 is issued.

Coolant Jacket Coolant Level Control Routine

Figure 14:
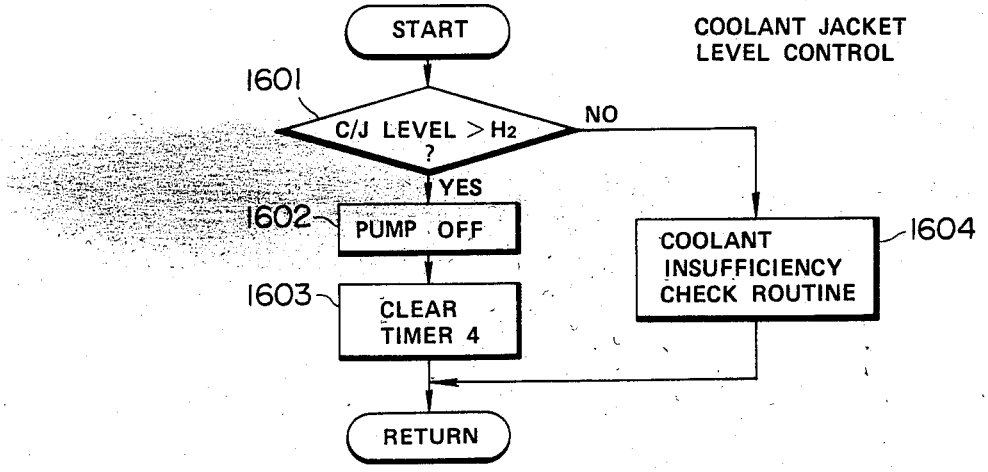
Figure 15:
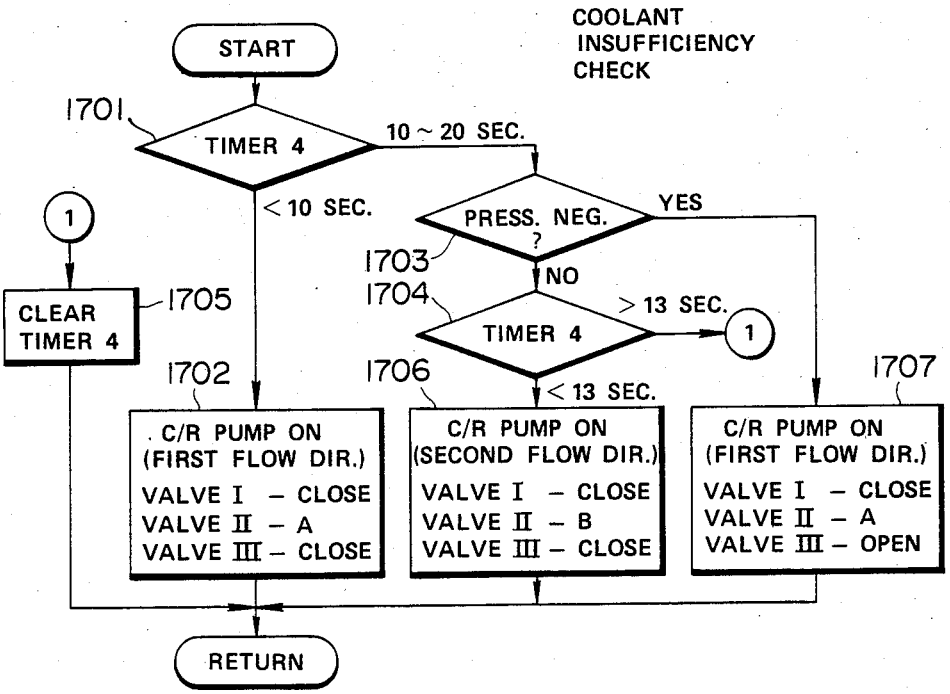

FIG. 14 shows the steps executed in order to maintain the level of liquid coolant in the coolant jacket 206 at level H1. At step 1601 the level of coolant in the coolant jacket 206 is determined by sampling the output of level sensor 220. In the event that the level of coolant is above sensor 220 then the program flows to steps 1602 and 1603 wherein a command to stop the operation of pump 218 is issued and soft clock 'timer 4' cleared. On the contrary, if the level of coolant is below that of level sensor 220 then at step 1604 a 'coolant insufficiently check' is performed.

Coolant Insufficiently Check Routine

Upon entering this routine, timer 4 which was cleared in step 1603 is set counting. As long as timer 4 does not count beyond 10 seconds the program is caused to flow from step 1701 to step 1702 wherein instruction to energize pump 218 in the first flow direction, condition valve II to produce flow path A and induce valves I and III to close, are issued.

However, if the count reaches a value between 10 and 20 seconds, then the program switches to step 1703 wherein the output of pressure differential switch arrangement 240 is sampled to determine if the pressure in the cooling circuit has dropped below atmospheric by a predetermined amount. In the event that the pressure is not negative then the program proceeds to step 1704 where the current count of timer 4 is checked. If the count has exceeded 13 seconds then the programs goes to step 1705 wherein the timer is cleared. On the other hand, if the count is still below 13 seconds, then at step 1706 instructions to run pump 218 in the second flow direction, condition valves I and III to close and cause valve II to produce flow path B are issued.

However, if the outcome of the pressure inquiry at step 1703 indicates that the pressure in the cooling circuit is in fact negative, then at step 1707 orders are issued to run pump 218 in the first flow direction, close valve I, condition valve II to provide flow path A and open valve III.

As will be appreciated, the function of step 1702 is to place pump 218 and the valve and conduit means in what shall be referred to as a 'normal' operation state, while step 1706 is such as to condition the system to forceably pump coolant into the cooling circuit while in an essentially closed circuit condition. On the other hand, the function of step 1707 is such as to permit coolant to be inducted into the lower tank 214 and radiator 210 under the influence of a pressure differential which has developed between the interior of the system and the ambient atmosphere.

Radiator Level Reduction Control Routine

Figure 16:
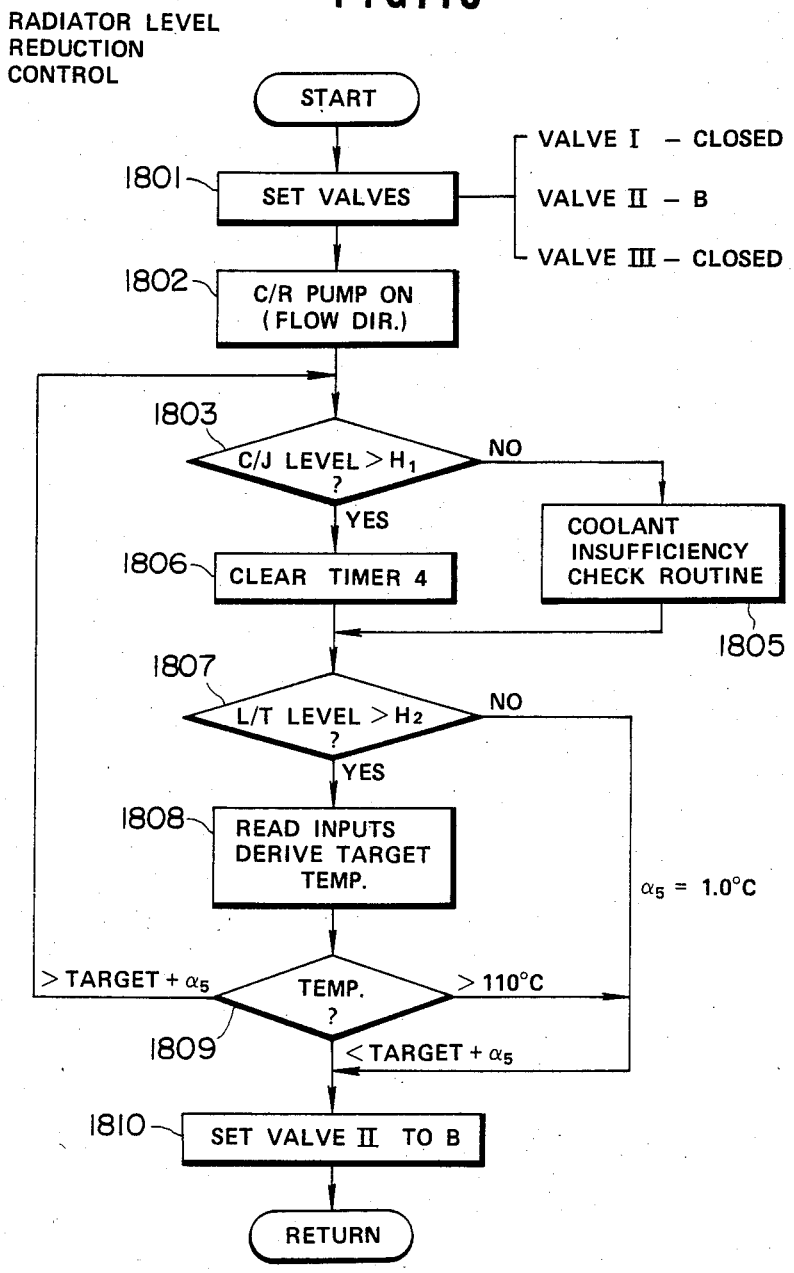

As it is possible that the level of coolant in the radiator 210 is, under a given control lowered to level H2 or alternatively is raised in order to prevent overcooling of the engine, it is deemed advantageous to run control programs which inspect the coolant levels and make periodic adjustments. In this case the control is directed to reducing the amount of coolant in the radiator. As shown in FIG. 16, at step 1801 valves I to III are conditioned in a manner which establishes fluid communication between the reservoir 224 and the lower tank 214 while maintaining the system in an otherwise hermetically sealed condition. At step 1802, pump 218 is energized to pump in the second flow direction and thus induct coolant from the lower tank 214 and direct it back out to the reservoir 224. At step 1803 the level of coolant in the coolant jacket 206 is checked by sampling the output of level sensor 220. If the outcome of this step indicates that the level of coolant in the coolant jacket is lower than H1 then the program goes to step 1804 wherein the previously described coolant insufficiency check routine is run. However, if the level of coolant is found to be above H1 then the program proceeds to step 1805 wherein valve II is conditioned to produce flow path B and a command to close valve III is issued. At step 1806 timer 4 is cleared and at step 1807 the level of coolant in the lower tank 214 is determined by sampling the output of level sensor 250.

In the event that the level of coolant in the lower tank 214 is above level H2 then the program proceeds directly to step 1810 wherein valve II is conditioned to establish flow path A. On the other hand, if the level of coolant in the lower tank 214 is still above H2 then it is deemed possible to safely displace more coolant from the system and accordingly, the current valve condition is maintained and at step 1808 the engine speed and load inputs are read and the instant target temperature is derived.

At step 1809 the temperature of the coolant is sampled and in the event that it is greater than target$+\alpha 5$ then the program recycles to step 1803. However, if the temperature is less than target$+\alpha 5$ then the program proceeds to step 1810 wherein the command to condition valve II to produced flow path A is issued. This of course terminates the forced coolant displacement and places the system in what has been referred to hereinbefore as a 'normal' closed state.

Radiator Coolant Level Increase Control

Figure 17:
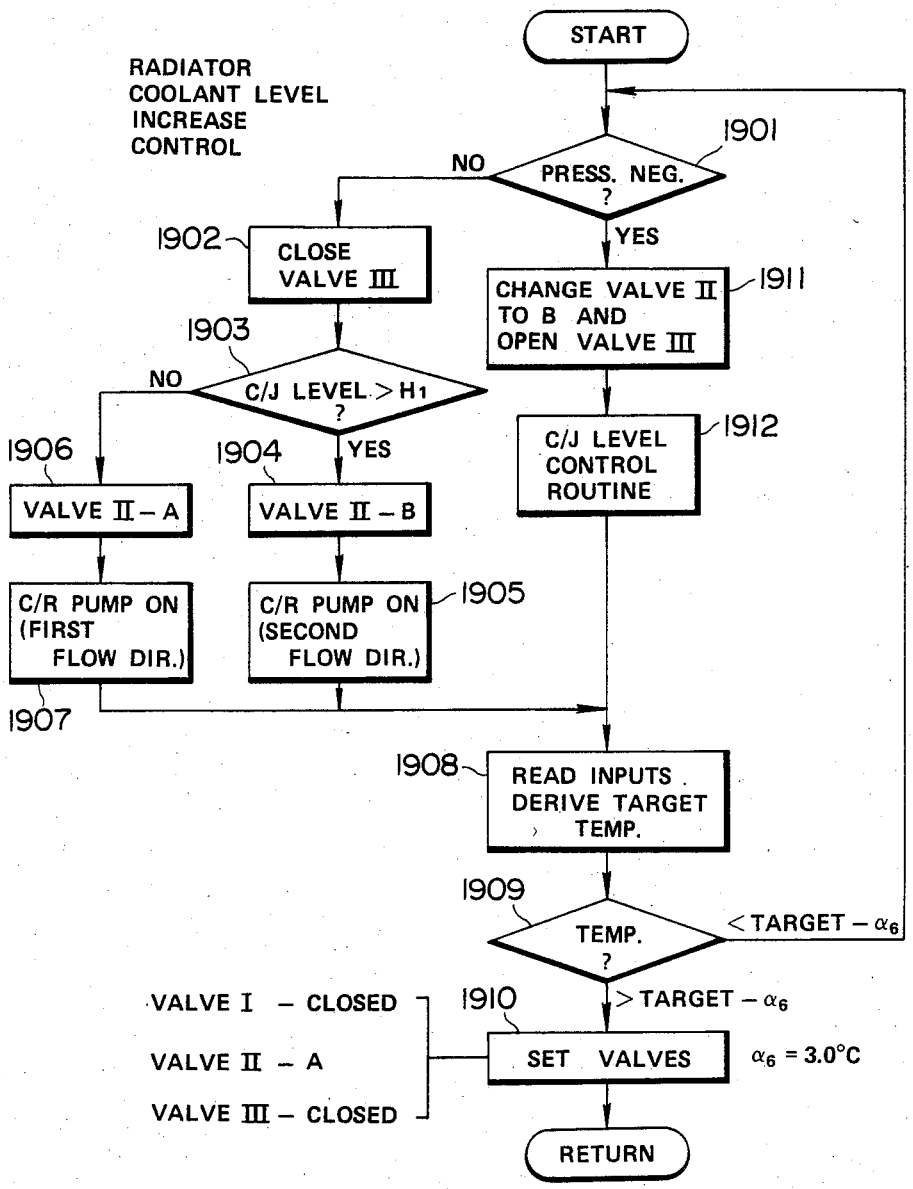

FIG. 17 shows the steps which are executed by the present invention in the event that the pressure in the system drops or otherwise requires that the amount of coolant contained in the lower tank and radiator be increased.

As will be appreciated by referring back to FIG. 9, this routine is entered in response to the coolant temperature being sensed as being below a value of target$-\alpha 4$ at step 1009.

As shown, upon being entered, the first step of this routine is such as to sample the output of the pressure differential responsive valve arrangement 240 and determine if the pressure in the cooling circuit is above or below atmospheric (viz., above or below a slightly negative pressure defined by the setting of the switch arrangement). In the event that the pressure in the system is not sub-atmospheric then the program proceeds to step 1902 wherein a command to close valve III is issued. Following this, the level of coolant in the coolant jacket 206 is determined by sampling the output of level sensor 220. In the event that the coolant level is above level H1 then steps 1904 and 1905 are executed. These steps set valve II to produce flow path B and induce the coolant return pump 218 to operate to pump in the second flow direction. This of course causes the system to induct coolant from reservoir 224 and force same into the lower tank 214 and radiator 210. On the other hand, if the outcome of the enquiry performed at step 1903 is such as to indicate that the level of coolant in the coolant jacket 206 is lower than H1 then at step 1906 valve II is conditioned to produce flow path A and subsequently at step 1907 pump 218 is energized in the first flow direction. This of course moves coolant from the lower tank 214 to the coolant jacket 206.

At step 1908 the most appropriate coolant temperature (target) is determined in view of the instant engine speed and load. Following this, the temperature of the coolant is sampled and, in the event that level so same is less than target$-\alpha 6$ then the program recycles to step 1901. However, if at this point the temperature of the coolant is greater than target$-\alpha 6$ then at step 1910 the valves are conditioned as shown to place the system in the so called 'normal' closed state.

However, if at step 1901 the pressure in the system is indicated as being negative then valve II is arranged to establish flow path A while valve III is opened. This conditioning takes advantage of the fact that a negative pressure is available to induct coolant from reservoir 224. Following this, the coolant jacket level control routine is run in step 1912 so as to prevent any lack of coolant therein while the circuit is rendered 'open circuit'. As shown steps 1908 to 1910 follow on from step 1912.

Excessively High Temperature Control

The first step of this control is such as to set valve I to III as shown. Viz., condition the system so that valve III is open to permit communication between the lower tank 214 and the reservoir 224 and thus permit coolant vapor to vent out to the radiator 210 in a manner allows a sudden flow of coolant vapor downwardly through the radiator tubing which tends to scavenge out any stubborn pockets of air. At step 2002 the coolant temperature is sampled to as to determine the effect of the venting permitted in step 2001. In the event that temperature is above a predetermined level (115° C. by way of example) valve I is additionally opened at step 2003 to permit vapor to vent via the overflow conduit 226 as well as via the fill/displacement conduit 236. However, if the temperature is (and/or drops to) within 208° to 113° C. then at step 2004 a command is issued to close valve I. Subsequent to steps 2003 and 2004 the coolant jacket coolant level control routine is run to ensure that while the system is in an 'open' state the level of coolant in the coolant jacket is not permitted to fall below H1. When the coolant temperature drops to a temperature lower than 108° C. the program proceeds to step 2006 wherein valves I and III are closed hermetically close the coolant circuit once more.

Shut-down Control Routine

The first step of this routine (step 2101) is such as to determine the instant coolant temperature. If the temperature is below 80° C. then it is assumed that it is safe to de-energize the system and allow the coolant from the reservoir 224 to be gradually inducted into the system as the residual coolant vapor condenses to its liquid state. However, if the temperature is still above this particular level then at step 2102 a new 'cool-down' target value is established. By so doing fan 224 is energized. At step 2103 a soft clock or 'timer' is set counting. While the count remains below 10 seconds, the program is induced to flow to step 2104 whereat it is determined if the coolant temperature is below 97° C. and the pressure in the system negative. If the outcome of this enquiry reveals that it still is not advisable to permit the system to assume an open circuit state, then the program goes to step 2106 where timer 3 is set. While the count generated by this timer is less than the equivalent of 60 seconds the program is induced to return for further runs. Power to the system is finally cut off upon one of the temperature dropping to 80° C. (step 2101), the temperature and pressure being simultaneously below 97° C. and negative respectively, or count produced by timer 3 exceeding 1 minute.

What is claimed is:

1. In an internal combustion engine having a structure subject to high heat flux;

(a) a cooling circuit for removing heat from said engine comprising:
- a coolant jacket formed about said structure, said coolant jacket being arranged to receive coolant in liquid form and discharge same in gaseous form;
- a radiator in which the gaseous coolant produced in said coolant jacket is condensed to its liquid form;
- a vapor transfer conduit leading from said coolant jacket to said radiator for transfering gaseous coolant from said coolant jacket to said radiator;
- a device associated with said radiator for varying the rate of heat exchange between said radiator and a cooling medium surrounding the radiator;
- a liquid coolant return conduit leading from said radiator to said coolant jacket for returning coolant condensed to its liquid state in said radiator to said coolant jacket;

(b) a reservoir the interior of which is maintained constantly at atmospheric pressure;

(c) valve and conduit means for selectively interconnecting said reservoir and said cooling circuit, said valve and conduit means including;
- a supply conduit which leads from said reservoir to the bottom of said radiator;
- a first valve disposed in said supply conduit, said first valve having a first position wherein communication between said reservoir and said radiator is permitted and a second position wherein the fluid communication between said reservoir and said radiator is prevented;

a second three-way valve disposed in said return conduit and a level control conduit leading from said three-way valve to said reservoir, said three-way valve having a first state wherein fluid communication between said radiator and said coolant jacket is interrupted and communication between said radiator and said reservoir established, and a second state wherein communication between said reservoir and said radiator is interrupted and communication between said radiator and said coolant jacket established;

an overflow conduit which fluidly communicates with said cooling circuit at a first end thereof and with said reservoir at a second end thereof;

a third valve disposed in said overflow conduit, said third valve having a first position wherein fluid communication between said cooling circuit via said overflow conduit is prevented and a second position wherein fluid communication between said cooling circuit and said radiator via said overflow conduit is permitted;

a reversible pump disposed in said coolant return conduit at a location between said radiator and said three-way valve, said pump being selectively energizable to pump coolant in (a) a first flow direction from said radiator toward said three-way valve and (b) in a second flow direction from said three-way valve toward said radiator;

a first sensor for sensing a parameter which varies with the temperature of the liquid coolant in said coolant jacket;

a second sensor for sensing a parameter which varies with the load on the engine; and a control circuit responsive to said first and second sensors for controlling the operation of said device, said valve and conduit means and said pump, said control circuit including means for:

determining the operational mode of the engine;

deriving a target temperature at which the liquid coolant in said coolant jacket should be maintained;

operating said device in a manner to vary the rate of condensation in said radiator and bring the temperature of the coolant in said coolant jacket to said target temperature;

operating said first valve in a manner which vents excess pressure from said cooling circuit in the event that said first sensor indicates that the temperature in said coolant jacket is in excess of a maximum permissible limit; and operating said third valve in a manner to permit communication between said cooling circuit and said reservoir via said overflow conduit in the event that the temperature and pressure in said cooling circuit do not decrease below said maximum permissible limit within a predetermined time period after said first valve is opened for said venting purpose.

2. An internal combustion engine as claimed in claim 1 further comprising:

means responsive to the pressure differential between the interior and exterior of said cooling circuit, said pressure differential means being arranged to output a signal indicative of a predetermined pressure differential existing between the interior and exterior of said cooling circuit.

3. An internal combustion engine as claimed in claim 1 wherein said engine includes:

a cylinder block;

a cylinder head detachably secured to said cylinder block;

means defining cavities in said cylinder head and cylinder block which cavities define said coolant jacket; and wherein said coolant return conduit communicates with a cavity formed in said cylinder head.

4. A method of cooling an internal combustion engine comprising the steps of:

introducing liquid coolant into a cooling circuit which includes a coolant jacked formed about structure of the engine subject to high heat flux;

permitting the coolant in said coolant jacket to boil and produce coolant vapor;

transferring the coolant vapor to a radiator which defines a further section of said cooling circuit;

condensing the coolant to its liquid form in said radiator;

sensing operational parameters of said engine using operational parameter sensing means to determine the operational condition of said engine;

sensing the temperature of the coolant in said coolant jacket using a temperature sensor;

using the data obtained during said step of sensing operational parameters to derive a target temperature at which the coolant in said coolant jacket should be maintained under the operational conditions;

using a device located externally of said radiator to vary the rate of heat exchange between the radiator and a cooling medium surrounding said radiator in a manner which tends to bring the temperature of said coolant to said target temperature;

venting pressure prevailing in said cooling circuit to the ambient atmosphere through a first valve in the event that said temperature sensor indicates that the temperature in said cooling circuit is above a maximum upper limit; and venting pressure prevailing in said cooling circuit to the ambient atmosphere through a second valve in the event that the temperature and pressure in said coolant jacket do not decrease below said maximum upper limit within a predetermined time after said first valve is opened for said venting purpose.

5. A method as claimed in claim 4, further comprising the step of arranging said second valve at a level which is higher than said first valve.

* * * * *